US006719275B1

(12) United States Patent
Waterson

(10) Patent No.: US 6,719,275 B1
(45) Date of Patent: Apr. 13, 2004

(54) DRIVE ASSEMBLY

(75) Inventor: Alaric Waterson, Dalkeith (GB)

(73) Assignee: Mactaggart Scott (Holdings) Limited, Midlothian (GB)

( * ) Notice: Subject to any disclaimer, the term of this patent is extended or adjusted under 35 U.S.C. 154(b) by 0 days.

(21) Appl. No.: 09/831,102

(22) PCT Filed: Nov. 3, 1997

(86) PCT No.: PCT/GB97/03018

§ 371 (c)(1),
(2), (4) Date: Nov. 1, 2001

(87) PCT Pub. No.: WO99/23026

PCT Pub. Date: May 14, 1999

(51) Int. Cl.[7] ..... B66D 1/00
(52) U.S. Cl. ..... 254/333; 226/171
(58) Field of Search ..... 226/170, 171, 226/172, 180, 195; 254/333, 265

(56) References Cited

U.S. PATENT DOCUMENTS

| | | | | | |
|---|---|---|---|---|---|
| 744,039 | A | * | 11/1903 | Brown | 355/108 |
| 1,394,328 | A | | 10/1921 | Miller | |
| 2,475,809 | A | * | 7/1949 | Sullivan et al. | 34/565 |
| 2,563,184 | A | * | 8/1951 | Naylor | 198/605 |
| 2,875,890 | A | | 3/1959 | Good | |
| 3,005,510 | A | | 10/1961 | Phillips | |
| 4,033,741 | A | * | 7/1977 | Drummond | 65/381 |
| 4,099,429 | A | | 7/1978 | Hauk | 81/57.17 |
| 4,179,056 | A | * | 12/1979 | Schmerling | 226/171 |
| 4,242,709 | A | | 12/1980 | Stricker | 360/96.4 |
| 4,603,799 | A | * | 8/1986 | Schaerer | 226/171 |
| 4,633,177 | A | * | 12/1986 | David et al. | 324/220 |
| 5,009,353 | A | * | 4/1991 | Alquist | 226/172 |
| 5,150,850 | A | | 9/1992 | Adams | 242/66 |
| 6,152,345 | A | * | 11/2000 | Griffin et al. | 226/172 |

FOREIGN PATENT DOCUMENTS

| | | | |
|---|---|---|---|
| EP | 0 176 463 A1 | 4/1986 | A01K/73/06 |
| EP | 0 338 932 A1 | 10/1989 | B65H/51/14 |
| GB | 607558 | 9/1948 | |

* cited by examiner

*Primary Examiner*—Kathy Matecki
*Assistant Examiner*—Evan Langdon
(74) *Attorney, Agent, or Firm*—Jones Day

(57) ABSTRACT

A drive assembly (22) for a policy (26) comprises a first pulley (26) having a cable (20) passing around part of the pulley circumference. Three relatively small pulleys (30, 32, 34) are mounted on the assembly body (24) and a belt (36) extends around the pulleys. The belt (36) is driven and two of the small pulleys (30, 34) are located on a chord of the first pulley (26) such that tension in the belt (36) tends to bias the belt (36) to bear against the cable (20) as it passes around a portion of the circumference of the first pulley (26) located between the two small pulleys (30, 34). In a further embodiment, a convex support surface (70; 86) is formed by a belt (62) or rollers (92), rather than by the pulley (26). In another embodiment an assembly (150) may be used to drive a ground engaging wheel (164) of an aircraft or vehicle, rather than a pulley wheel (26).

6 Claims, 3 Drawing Sheets

DRIVE ASSEMBLY

FIELD OF THE INVENTION

This invention relates to a drive assembly. The assembly may be utilised to drive a flexible elongate member such as cable or the like. Another aspect of the invention may be utilised to drive a pulley or a ground engaging wheel of an aircraft. The invention also relates to a method of driving a flexible elongate member such as a cable or wheel.

BACKGROUND OF THE INVENTION

The deployment, or veering, of cable from a winch drum is often achieved by applying a tension to the cable to draw it from the drum. In a number of applications this veering may be achieved by means of the load present on the cable, for example, in a towed sonar array as might be deployed from a submarine or ship, the array is deployed from a winding drum mounted on the vessel by means of the drag on the array created by the surrounding water. However, initially, when only a short length of cable is deployed, the drag may not be sufficient to veer the cable from the winding drum and to pull the cable over the various pulley wheels that are provided between the drum and the point where the cable passes from the vessel. Such initial tension may be provided by a cable drive assembly beyond the last pulley wheel on the vessel, as will be described below.

When hauling in or recovering a cable or sonar array the winch drum is rotated in the opposite direction. The drag experienced by the sonar array, which may be several hundred metres long, places a significant load on the array and thus a significant load on the winch drum. This load may be sufficient to crush and damage the coils of cable already present on the drum, and may make spooling of the cable onto the drum difficult. To avoid this difficulty, a cable drive assembly as mentioned above may be utilised to haul in or recover the cable and reduce the tension in the cable as it is wound onto the drum: the drive assembly hauls in a portion of the recovery load and the winch drum hauls in the remainder of the recovery load.

The cable drive assembly may be a pair of driven rollers to form a nip beyond the last pulley wheel on the vessel. However, the point loads created by such a nip may damage the cable. In other arrangements, pairs of opposed driven belts are utilised to apply tension to the cable. The belts are maintained in contact with the cable by pivotally mounted longitudinally extending low friction supports. The supports are biassed inwardly towards one another by springs. However, the cables, and in particular towed sonar arrays, may be "lumpy", that is the cables are not or a constant diameter, and the larger diameter portions are not accommodated easily by the supports; when the supports are pushed apart to allow the larger diameter portions to pass, the smaller diameter sections of cable will not be gripped by the belts and the larger diameter portions will experience significant point loads and may be subject to damage or accelerated wear.

An alternative arrangement for handling cable is described in U.S. Pat. No. 3,329,406 to Flair, which discloses a capstan type cable drive comprising a cable drum about the outer surface of which several cable turns are wound and an endless belt which is carried by a plurality of driven sheaves arranged in a planetary fashion about the drum so that the belt defines a spiral or helical confining surface which imparts moving force to the cable during cable deployment. Such an arrangement will not accommodate "lumpy" cable or sonar arrays as the sheaves are fixed relative to the cable drum and there is therefore a fixed clearance therebetween. Further, many cables and sonar arrays will only withstand a minimal degree of bending before suffering damage, such that the diameter of the drum would have to be relatively large and, together with the sheaves mounted around the drum, would occupy a large volume, which represents a distinct disadvantage in applications where space is at a premium, such as on a submarine.

Arrangements for maintaining a flexible member, such as an anchor rope in contact with a driven pulley are described in European Patent Application 0 176 463, and in U.S. Pat. No. 3,847,378. Both documents describe arrangements in which a belt is passed around a number of smaller pulleys located adjacent the larger driven pulley such that the belt presses the rope into contact with the driven pulley. However, in the disclosed arrangements the sole purpose of the belt is to ensure adequate frictional contact between the rope and the driven pulley.

UK Patent 1 368 157 discloses an arrangement in which a rope passes around a driven pulley and is clamped thereto by a series of clamping jaws mounted on an untensioned endless chain. The jaws positively engage notches on the driven pulley to ensure that the jaws follow the rope without any relative slipping. The jaws are urged into contact with the rope by spring-biassed pressure rollers.

It is among the objects of at least one aspect of the present invention to provide a drive assembly for a flexible elongate member such as a cable or sonar array having portions of different diameter.

SUMMARY OF THE INVENTION

According to the present invention there is provided a drive assembly for a flexible elongate member, the assembly comprising:

- a support defining a convex arcuate support surface for engaging a flexible elongate member;
- a tensioned flexible drive member opposing the convex support surface and defining a support portion for engaging the flexible elongate member;
- first and second supports for the drive member, the supports being located on a chord of a curve whereby the drive member defines a concave arcuate support portion and tension in the drive member tends to bias the member to bear against the flexible elongate member.

The invention also relates to a method of applying a linear force to a flexible elongate member such as a cable or the like.

The manner in which the drive member is urged into contact with the flexible elongate member, that is by locating the drive member supports on a chord of a curve such that the tensioned drive member defines a concave arcuate support portion, with the tension in the drive member tending to bias the member to bear against the flexible elongate member, facilitates handling of "lumpy" cables and the like; there is no requirement to provide support surfaces or rollers behind the drive member, and larger diameter portions of the cable are readily accommodated by flexing of the drive member.

The arrangement allows a linear force to be applied to a cable and the like without applying any significant radial or point loads thereto, as the force is applied to the cable over the length of the support portion. Thus, the assembly may be utilised to deploy or veer cable from a winch drum and to wind or haul cable onto a drum.

The assembly may be provided directly on a winch drum, or may be provided separately of the drum.

The invention has particular application in the deployment and retrieval of towed sonar arrays, in which the cable may be damaged if subject to high radial compressive forces. When deploying the array, the assembly may provide an initial tension to veer the cable from the winch drum. Then, once the drag on the array is sufficient to pull the cable from the drum, the assembly may run free. However, when the drag on the array reaches a level where the remaining coils of cable on the winch drum may be subject to a compressive force sufficient to damage the cable the assembly may provide drag on the cable to reduce the tension in the cable between the assembly first pulley and the winch drum. Further, the assembly may be utilised to haul the cable and retrieve the sonar array, allowing the cable to be wound onto the drum under minimal tension.

Preferably, the drive member supports comprise one or more pulleys. Most preferably, at least one of the pulleys is driven. Preferably also, at least one of the pulleys is mounted via biassing means to impart an initial tension in the flexible member.

Preferably also, the drive member is in the form of a belt, which may be toothed.

The support defining the convex arcuate support surface may be a pulley, preferably a relatively large diameter pulley. The convex support surface may be provided by a segment or arc of the pulley, preferably an arc of less than 270°, most preferably an arc of less than 180°, and in one preferred embodiment a 90° arc.

In other embodiments the convex arcuate support surface may be provided by a belt passing around appropriate idler pulleys and supported at said surface by a low friction surface or multiple rollers. Alternatively, the support surface may be defined by a low friction surface or multiple rollers.

According to another aspect of the present invention there is provided an assembly for driving a wheel, the assembly comprising: a body; at least three pulleys mounted on the body; a flexible member extending around the pulleys; and means for driving the flexible member, two of the pulleys being locatable on a chord of a wheel to be driven such that tension in the flexible member tends to bias the member to bear on a portion of the circumference of a wheel located between said two of the pulleys.

The invention also relates to a method of driving a wheel.

The assembly may be provided in conjunction with a relatively large pulley wheel for providing drive for the pulley. Alternatively, the assembly may be utilised for driving a ground engaging wheel of a vehicle or aircraft to, for example, manoeuvre an aircraft on the deck of a ship. For such an application it is preferable that the said two of the pulleys are locatable relative to the wheel such that the flexible member extends around over half of the circumference of the wheel. of course this provides a greater degree of friction between the flexible member and the wheel and also facilitates securing the assembly on the wheel. With such an arrangement it is also desirable that at least one of said two pulleys is movably mounted to facilitate mounting and dismounting of the assembly from the wheel.

Preferably, one of the pulleys is driven and imparts a tension on the flexible member.

Preferably also, one of the pulleys is mounted on the body via biassing means to impart an initial tension in the flexible member.

Preferably also, the flexible member is in the form of a belt, which may be toothed.

BRIEF DESCRIPTION OF THE DRAWINGS

These and other aspects of the present invention will now be described, by way of example, with reference to the accompanying drawings, in which:

FIG. 8 is a somewhat schematic plan view of a submarine including a towed sonar array deployment system including a drive assembly in accordance with an alternative embodiment of the present invention.

DETAILED DESCRIPTION OF THE DRAWINGS

Figures 1, 2:
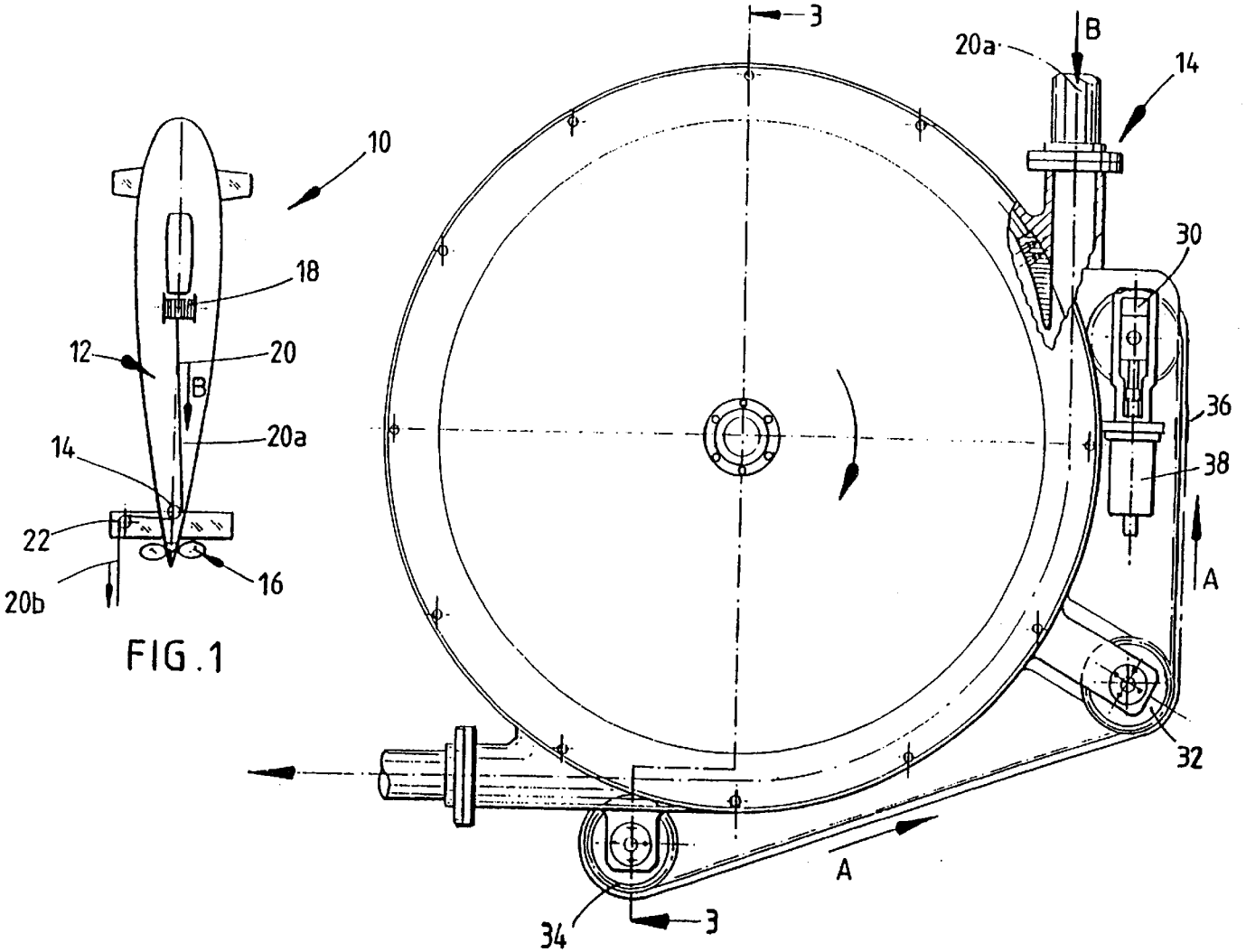
FIG. 1 is a somewhat schematic plan view of a submarine including a towed sonar array deployment system including a drive assembly for a pulley in accordance with a preferred embodiment of the present invention.
FIG. 2 is a plan view of a drive assembly of the deployment system of FIG. 1.

Reference is first made to FIG. 1 of the drawings which illustrates a submarine 10 provided with a towed sonar array deployment system 12 incorporating a drive or pulley assembly 22 in accordance with a preferred embodiment of the present invention. The system 12 is utilised to deploy a towed sonar array from a winch drum 18 located within the casing of the submarine 10. From the drum 18, the cable 20 which connects the array to the submarine is passed around two pulley assemblies 14, 22 which ensure that the cable 20 clears the propeller of the submarine 16. In an alternative embodiment, as illustrated in FIG. 8 of the drawings, a towed sonar array deployment system 112 includes a drive assembly 122 which is incorporated with a winch drum 118, to deploy and veer cable 120 directly from the drum 118.

Figure 3:
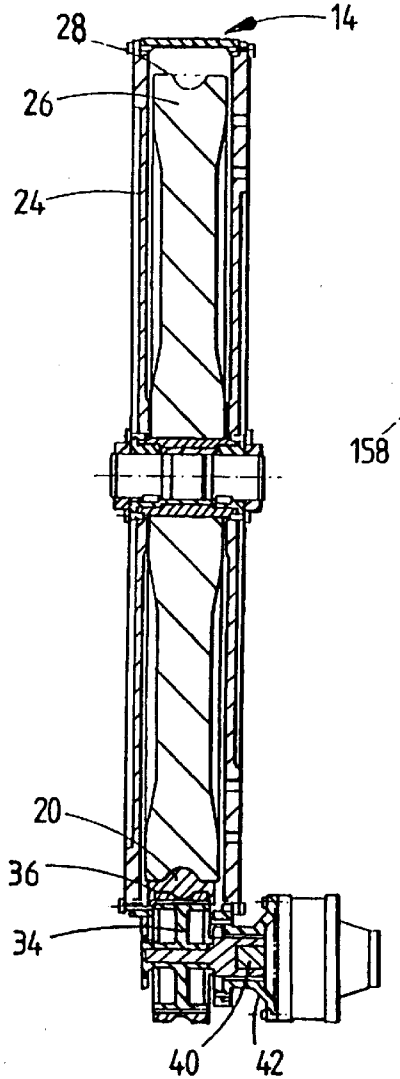
FIG. 3 is a sectional view on line 3—3 of FIG. 2.

Reference is now made to FIGS. 2 and 3 of the drawings which illustrate the pulley assembly 22 in greater detail. The assembly comprises a casing 24 which accommodates a first relatively large pulley wheel 26 with an outer face 28 grooved to accommodate the cable 20 as it passes around the pulley 26. Mounted within the casing 24 are three smaller pulley wheels, 30, 32, 34 and a flexible toothed belt 36 which extends therearound. Two of the pulleys 30, 34 are located on a chord of the larger pulley 26 such that tension in the belt 36 tends to bias the belt 36 to bear against the cable 20 as it passes around the first pulley 26. The pulleys 30, 34 are located adjacent the respective points on the circumference of the pulley 26 where the cable 20 engages the pulley 26. Thus, the larger pulley 26 defines a convex support surface extending over a 90° arc of the pulley outer face and the belt 36 defines an opposing concave arcuate support portion.

One of the smaller pulleys 30 is mounted on the casing via a loading cylinder 38 to impart an initial tension on the belt 36. Another of the small pulleys 34 is driven by a hydraulic motor 40 mounted to the casing 24 via a housing 42 to create further tension in the belt 36.

In use, the pulley assembly 22 may be used in the initial deployment of the sonar array when the level of drag on the array and cable 20 in the water beyond the pulley 22 is insufficient to pull the cable 20 from the winch drum 18. The motor 40 is utilised to drive the belt in the direction of the arrows A, the motor 40 also causing the pulley 34 to apply tension to the belt 36 which clamps the belt 36 against the cable 20 on the pulley 26. The cable 20 is thus pulled from the winch drum 18 in the direction of the arrows B.

Once the drag on the portion of the array and cable in the water reaches a level which is sufficient to pull the array from the winch drum 18, the assembly 22 may be permitted to run freely. However, as the drag on the array increases it may be desirable to limit the tension in the cable 20 being pulled from the winch drum 18, and which would otherwise crush and damage the cable 20 remaining on the winch drum 18. Thus, the assembly 22 may be utilised to apply a drag to the cable such that the tension in the cable 20*a* between the pulley assembly 22 and the winch drum 18 is considerably lower than the tension in the cable 20*b* beyond the pulley assembly 22.

The assembly 22 may also be utilised to haul the cable 20 and retrieve the sonar array. Thus, if the belt 36 is driven in the opposite direction the cable will be pulled in while the winch drum 18 is rotated to wind the cable 20 onto the drum 18. Again, the tension in the portion of the cable 20*a* between the pulley assembly 22 and the winch drum 18 is considerably lower than the tension in the cable 20*b* beyond the assembly 22.

The use of the tensioned belt 36 to drive the cable 20 allows larger diameter portions, or "lumps", in the cable 20 to be readily accommodated as the gap or "nip" between the belt 36 and the pulley wheel 26 is maintained solely by the tension in the belt 36 (the smaller pulleys 30, 34 are spaced from the pulley 26) such that a lump in the cable will be accommodated by flexing of the belt 36.

From the above description it will be seen that the pulley assembly 22 provides a simple and convenient means for veering or hauling the cable 20 and the use of the belt 36 to apply force to the cable 20 facilitates handling of irregular diameter portions in the cable 20. In the alternative embodiment of FIG. 8, the cable 120 is nipped between a belt and the winch drum 118.

Figure 4:
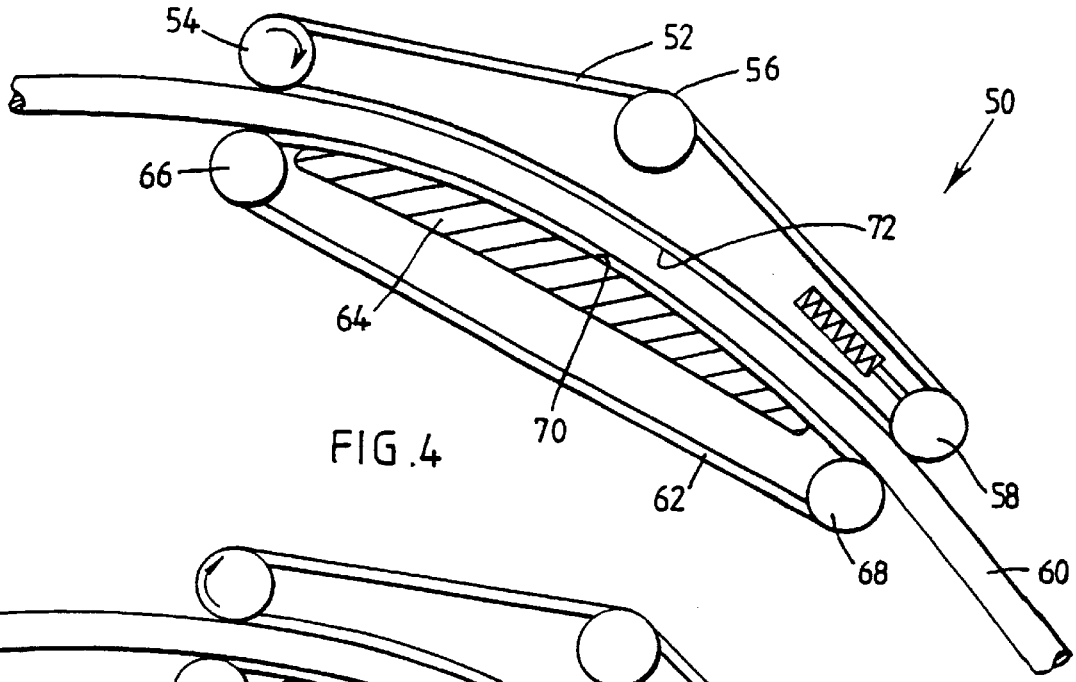
FIGS. 4, 5 and 6 are schematic plan views of drive assemblies in accordance with further embodiments of the present invention.
Figure 5:
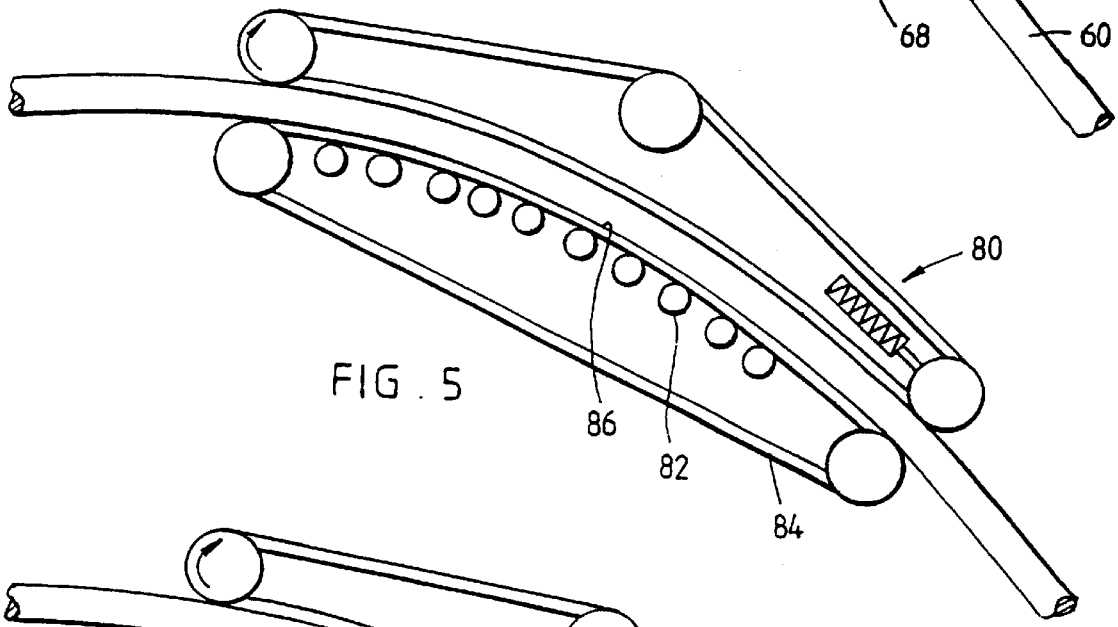
Figure 6:
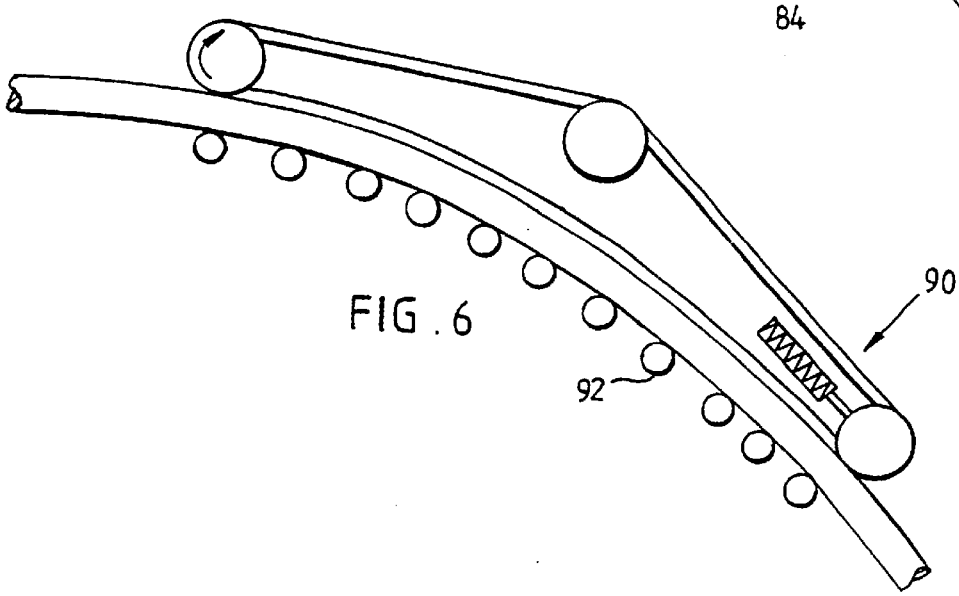

Reference is now made to FIGS. 4, 5 and 6 of the drawings, which illustrate alternative drive assemblies. Reference is first made to FIG. 4, which illustrates an assembly 50 having a drive arrangement somewhat similar to the drive arrangement of pulley assembly 22 described above, in that it comprises a drive belt 52 which passes around a driven pulley 54 and an idler pulley 56, and a spring loaded tensioning idler pulley 58. However, rather than the belt 52 co-operating with a relatively large pulley wheel as described above, the opposing support surface for the cable 60 is provided by a further belt 62 passing over a PTFE coated low friction surface 64 and around a pair of idler pulleys 66, 68. Thus, the belt 62 defines a convex arcuate support surface 70 for the cable 60, and the drive belt 52 defines a concave arcuate support surface 72.

With this arrangement, drive is transferred to the cable 60 over a relatively large area, and any larger diameter portions in the cables 60 are accommodated by radial deflection of the belt 52.

Reference is now made to FIG. 5, which illustrates an alternative drive assembly 80, in which the low friction surface 70 of FIG. 4 embodiment has been replaced by multiple rollers 82 which support a belt 84 to form a convex arcuate support surface 86.

FIG. 6 illustrates a further drive assembly 90 in which the convex arcuate support surface is provided by a series of rollers 92.

Figure 7:
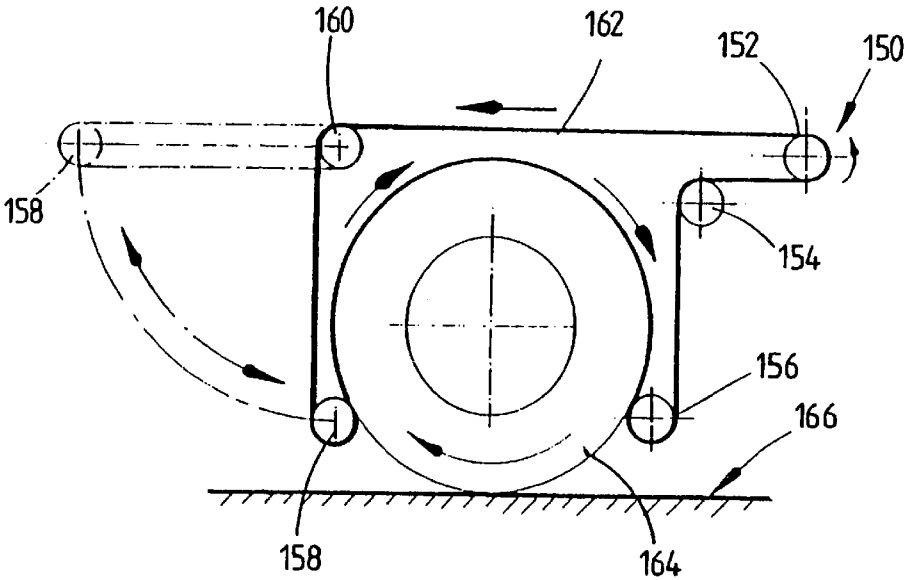
FIG. 7 is a somewhat schematic side view of a drive assembly in accordance with another embodiment of the present invention (on same sheet as FIG. 3)

By providing an assembly in accordance with an embodiment of the present invention on a portable carrier an assembly 150 may be utilised to drive wheels of, for example, an aircraft on the deck or a ship, as illustrated somewhat schematically in FIG. 7 of the drawings.

Such an assembly 150 includes a wheel-mounted body (not shown), carrying five small pulley wheels 152, 154, 156, 158, 160 with a belt 162 extending therearound. One of the pulleys 152 is driven and one of the pulleys 158 is mounted on the body so as to be movable to a position (shown in ghost outline) in which the assembly 150 can be wheeled, by an operator, to engage with, for example, the nose wheel of an aircraft 164 on the ground or the deck of a ship 166. The pulley 158 is then returned to a position adjacent the wheel 164 such that the belt 162 contacts a substantial portion of the circumference of the wheel 164.

Activation of the motor to drive the pulley 152 will create a tension in the belt 162, clamping the belt 162 against the wheel and, as the assembly 150 is restrained from rotating around the wheel 164 by contact with the ground/deck 166, driving the belt 162 will result in the wheel 164 rotating and the aircraft moving across the ground/deck 166.

Thus, this embodiment of the invention provides a simple and convenient arrangement for movement of aircraft over short distances.

It will be clear to those of skill in the art that the above described embodiments are merely exemplary of the present invention and that various modifications and improvements may be made thereto, without departing from the scope of the invention. For example, reference is made herein at various points to pulleys and pulley wheels, and it will be clear to those in the art that the term "pulley" is not intended to be restricted to rotatable pulley wheels, and in intended to encompass, for example, low friction guides which may be provided in place of pulley wheels.

What is claimed is:

1. A method of applying a linear force to a cable, the method comprising the steps of:

deploying and retrieving a cable in the form of a towed sonar array by deploying cable from a winch drum and winding cable onto a drum;

passing the cable around a convex arcuate support surface;

passing a flexible member around at least three relatively small pulleys, two of the pulleys being located on a chord of the support surface; and driving the flexible member by driving one of the small pulleys such that tension is created in the flexible member and tends to bias the member to bear against the cable passing around a portion of the support surface located between said two of the small pulleys and form a cable nip between the flexible member and the support surface;

wherein the support surface is provided separately of the drum and when deploying the array an initial tension is provided to veer the cable from the winch drum; then, once the drag on the array is sufficient to pull the cable from the drum, the flexible member is permitted to run free; and then when the drag on the array reaches a level where the remaining coils of cable on the winch drum are subject to a compressive force capable of damaging the cable the flexible member provides drag on the cable to reduce the tension in the cable between the support surface and the winch drum.

2. The method of claim 1 wherein when the cable is hauled to retrieve the sonar array, the cable is wound onto the drum under minimal tension.

3. The method of claim 1 wherein one of the smaller pulleys is biassed to impart an initial tension in the flexible member.

4. A method of deploying and veering a towed sonar array from a winch drum, the method comprising the steps of:

passing a towed sonar array from a winch drum around a convex arcuate support surface;

passing a flexible member around at least three relatively small pulleys, two of the pulleys being located on a chord of the support surface; and driving the flexible member by driving one of the small pulleys such that tension is created in the flexible member and tends to bias the member to bear against the towed sonar array passing around a portion of the support surface located between said two of the small pulleys, wherein when deploying the array an initial tension is provided to veer the cable from the winch drum; then, once the drag on the array is sufficient to pull the cable from the drum, the flexible member is permitted to run free; and then when the drag on the array reaches a level where the remaining coils of cable on the winch drum are subject to a compressive force capable of damaging the cable the flexible member provides drag on the cable to reduce the tension in the cable between the support surface and the winch drum.

5. The method of claim 4, wherein when the array is hauled to retrieve the array, the array is wound onto the drum under minimal tension.

6. The method of claim 4, wherein one of the smaller pulleys is biassed to impart an initial tension in the flexible member.

* * * * *

UNITED STATES PATENT AND TRADEMARK OFFICE

CERTIFICATE OF CORRECTION

PATENT NO. : 6,719,275 B1
DATED : April 13, 2004
INVENTOR(S) : Waterson

It is certified that error appears in the above-identified patent and that said Letters Patent is hereby corrected as shown below:

Drawings,
Figure 8, reproduced below, should be included among the drawings.

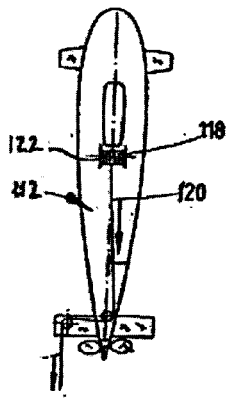

FIG.8

Signed and Sealed this

Seventeenth Day of August, 2004

JON W. DUDAS
*Acting Director of the United States Patent and Trademark Office*